US005702152A

United States Patent [19]

Shaw

[11] Patent Number: 5,702,152

[45] Date of Patent: Dec. 30, 1997

[54] CONVERTIBLE ROCKER

[76] Inventor: Donald Shaw, 170 Commander Blvd., Agincourt, Ontario, Canada, M1S 3C8

[21] Appl. No.: 615,946

[22] Filed: Mar. 14, 1996

[51] Int. Cl.[6] ..... A47C 3/02

[52] U.S. Cl. ..... 297/133; 297/271.6

[58] Field of Search ..... 297/258.1, 271.5, 297/271.6, 272.1, 133, 463.1

[56] References Cited

U.S. PATENT DOCUMENTS

| | | | |
|---|---|---|---|
| 315,369 | 4/1885 | Work . | |
| 406,400 | 7/1889 | Jacoby | 297/133 |
| 693,197 | 2/1902 | White | 297/271.6 |
| 1,367,390 | 2/1921 | Hinson | 297/133 |
| 1,566,157 | 12/1925 | Michaelson | 297/133 |
| 1,782,763 | 11/1930 | Overbey | 297/271.6 X |
| 4,047,753 | 9/1977 | Uchida . | |
| 4,079,991 | 3/1978 | Harris . | |
| 4,126,353 | 11/1978 | Clough . | |
| 4,807,926 | 2/1989 | Brunn . | |
| 5,211,443 | 5/1993 | Kelly . | |

*Primary Examiner*—Milton Nelson, Jr.
*Attorney, Agent, or Firm*—Paul Sharpe McFadden, Fincham

[57] ABSTRACT

Rocking members for releasable mounting on a chair having front legs and rear legs, the rocking members each comprising: an arcuate body having first channel members for releasably receiving at least a portion of a front leg of a chair; second channel members in spaced relation to the first channel members for receiving at least a portion of a rear leg of the chair and abutment members in each of the channel members for preventing lateral movement of a foot portion adjacent the abutment and lock members for releasably locking each foot portion in the channel members.

15 Claims, 3 Drawing Sheets

CONVERTIBLE ROCKER

FIELD OF THE INVENTION

The present invention relates to rocking members for use on a chair to convert the chair into a rocking chair. More particularly, the present invention relates to a simple arrangement to convert a chair into a rocking chair.

BACKGROUND OF THE INVENTION

Various rocker arrangements have been previously proposed in the art for converting conventional chairs into rocking chairs. Although the previous arrangements have merit, several of these devices involve either modification of the chair or the use of unsightly fixtures to convert the chair to a rocker.

One of the examples known in the art is that provided in U.S. Pat. No. 4,079,991, issued Mar. 21, 1978 to Harris. In the Harris arrangement, one embodiment provides arcuate rockers having generally semi-circular recesses to accommodate a chair having a tubular base. In addition, the rockers provide flexible lengths of material in order to secure the chair to the rocker. In another embodiment, a snap lock system is provided where the semi-circular openings are of a lesser diameter than the tubing of which the chair legs are made. In this manner, the user simply snaps the legs into the rocker.

Despite the utility of the arrangement provided in the Harris arrangement, the apparatus is limited to feet having a generally circular cross-section in order to fit into the semi-circular grooves to receive the feet. Additionally, in the case of the snap lock arrangement, it would appear that this arrangement is limited to possible mechanical wear over time by repeated removal of the rocker from the feet of the chair.

In a further example, U.S. Pat. No. 4,126,353, issued Nov. 21, 1978, Clough discloses a variation on the conversion kit to convert a chair into a rocker. In the Clough reference, the arrangement relies on the use of circular clamp fasteners which must be connected to the leg of the chair among other mechanical arrangements on the rocker. The result with the Clough arrangement is that the leg of the furniture may be damaged and in any event, conversion is somewhat involved in view of the fact that fasteners are included and must be fixedly secured to the leg. Similar to the Harris discussed hereinabove, the Clough system would be limited to certain shapes of chair legs.

In view of what the art has proposed for conversion units for converting non-rocking chairs into rocking chairs, it is clear that a need exists for an arrangement which can be employed to quickly change a non-rocking chair into a rocking chair without the disadvantages associated with the prior art. The present invention is directed to satisfying this need.

SUMMARY OF THE INVENTION

One object of the present invention is to provide an improved rocker arrangement for that which has been previously proposed in the art.

A further object of the present invention is to provide rocking members for releasable mounting on chairs having front legs and rear legs, the rocking members each comprising: first channel means for releasably receiving at least a portion of a front leg of a chair; second channel means in spaced relation to the first channel means for receiving at least a portion of a rear leg of a chair; abutment means in each channel means for preventing lateral movement of a foot portion adjacent the abutment and lock means for releasably locking the foot portion in the channel means.

Advantageously, the rocker arrangement provided in the present invention does not result in the damage of the chair, since no fasteners or other ancillary fastening equipment is necessary in order to secure the rocker to the chair.

A further advantage consistent with an embodiment of the present invention is that the rocking member is made of a durable material such as a plastic or resin and therefore does not rust or otherwise become damaged from the elements. This affords use in the outdoor environments. Further advantages relate to the fact that the apparatus is simply and quickly employable in order to convert a non-rocking chair into a rocking chair. Conveniently, the rocking members provide a multiple lock system in order to positively secure respective foot portions of the chair within the arrangement. In this manner, slippage or otherwise inadvertent disengagement of the foot portion from the rocker is prevented.

With the locking system employed in the present invention, once the foot is engaged in a respective channel, the foot is restrained against movement in all three planes and this adds stability to the entire arrangement as well as a user confidence.

According to a further object of the present invention, there is provided rocking members for releasable engagement with the feet of a chair, the rocking members being generally arcuate in profile, each including channel means for receiving a portion of a foot of a chair, the improvement comprising first lock means and second lock means for releasably locking a front foot portion and rear foot portion, respectively against movement in the channel means to fix the front foot portion and the rear foot portion in the channel means against movement.

Having thus generally described the invention, reference will now be made to the accompanying drawings illustrated in the preferred embodiments.

BRIEF DESCRIPTION OF THE DRAWINGS

Similar numerals used throughout the Figures denote similar elements.

DETAILED DESCRIPTION OF THE PREFERRED EMBODIMENTS

Figure 1:
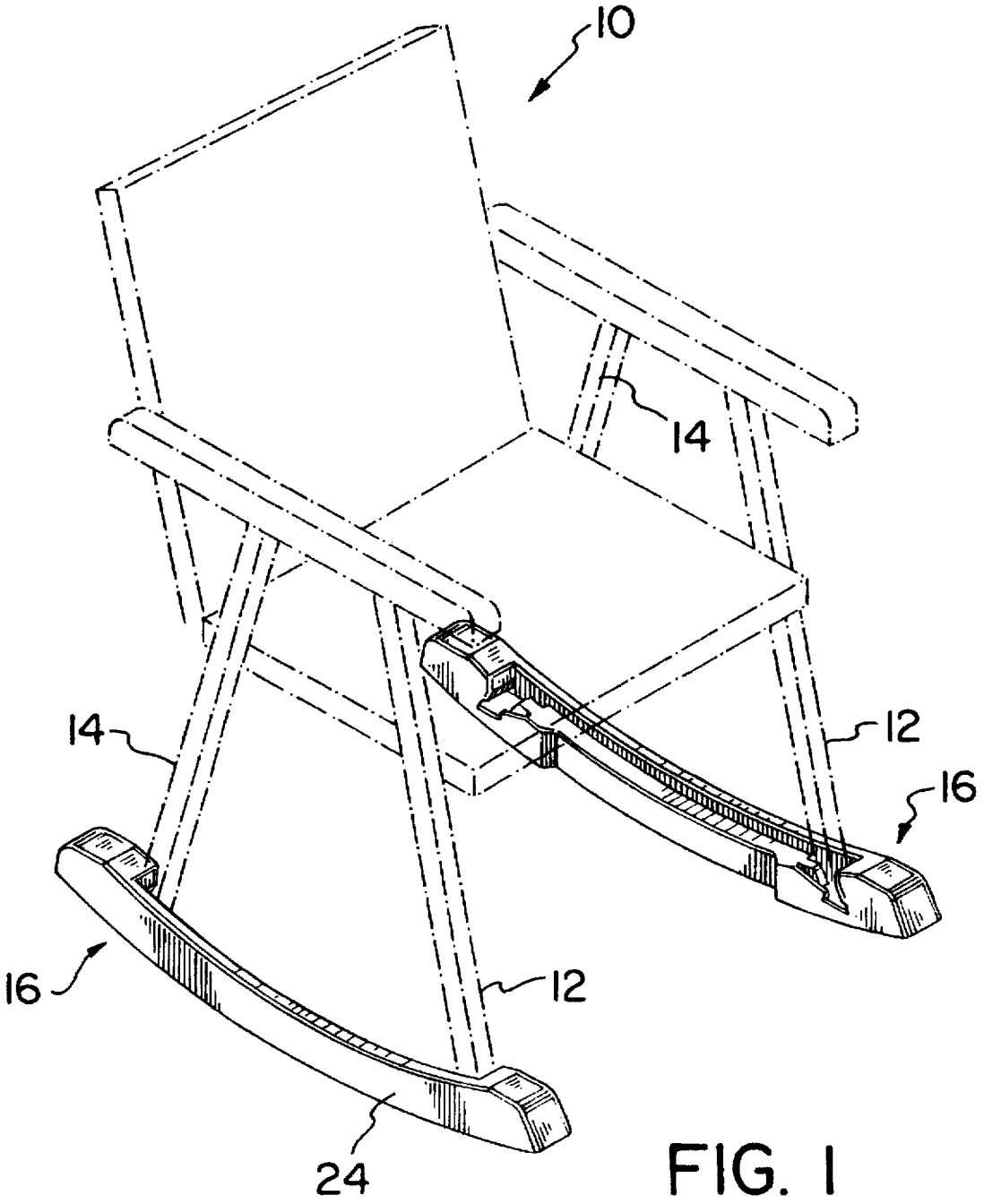
FIG. 1 is a perspective view of the rocker arrangement for use on a chair.

Referring now to FIG. 1, shown is a perspective view of a chair 10 (shown in chain line) having a pair of front legs 12 and rear legs 14. The front legs 12 and the rear legs 14 are shown engaged with the rocking members according to one embodiment thereof, and denoted globally by numeral 16.

Figure 2:
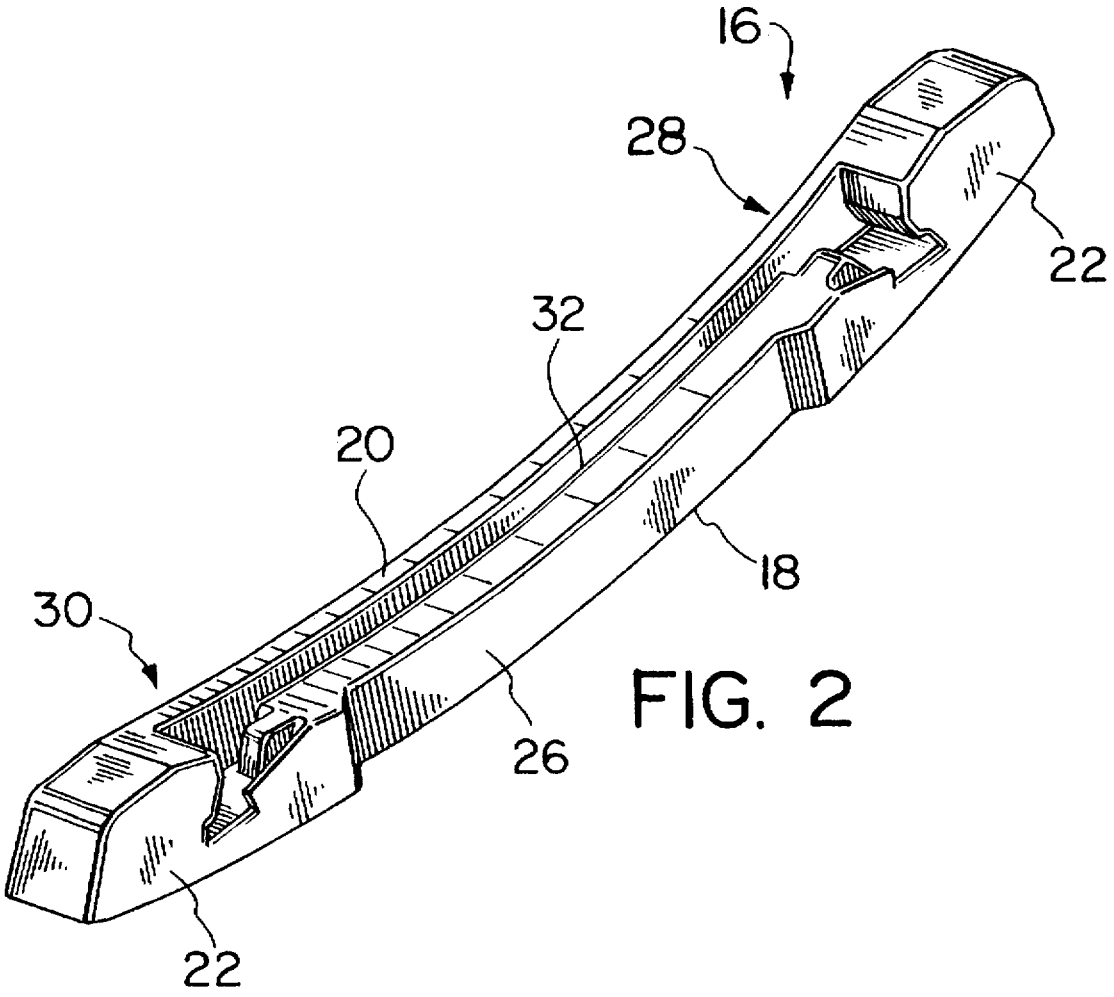
FIG. 2 is a perspective view of a rocker according to one embodiment of the invention.

Turning to FIG. 2, a perspective view of one of the rocking members 16 is shown in perspective view. Only one of the rocking members 16 will be discussed in the detailed description in view of the fact that the members are identical. Each one of the rocking members 16 includes an arcuate body, the body being composed of a suitably rigid material, e.g. plastic, metal, composites, etc. A suitably rigid plastic material is preferred since the rocking members are particularly well suited for converting patio furniture into rocking type chairs. In this manner, the plastic is not susceptible to the elements and therefore has long life.

Figure 3:
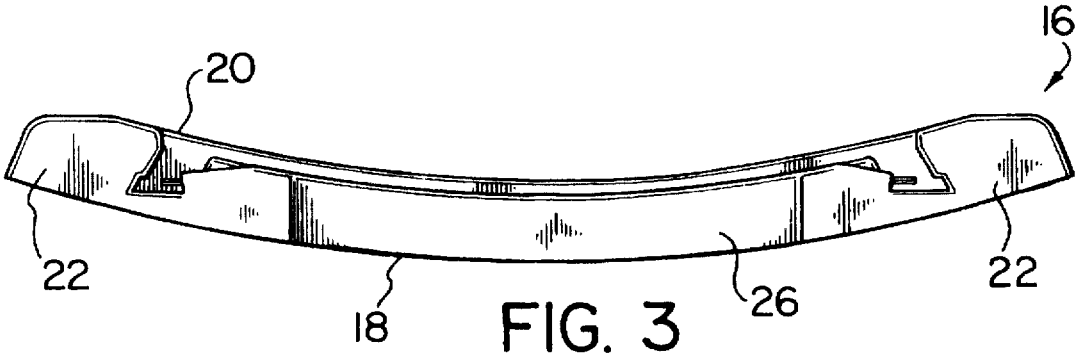
FIG. 3 is a side view of FIG. 2.
Figure 4:
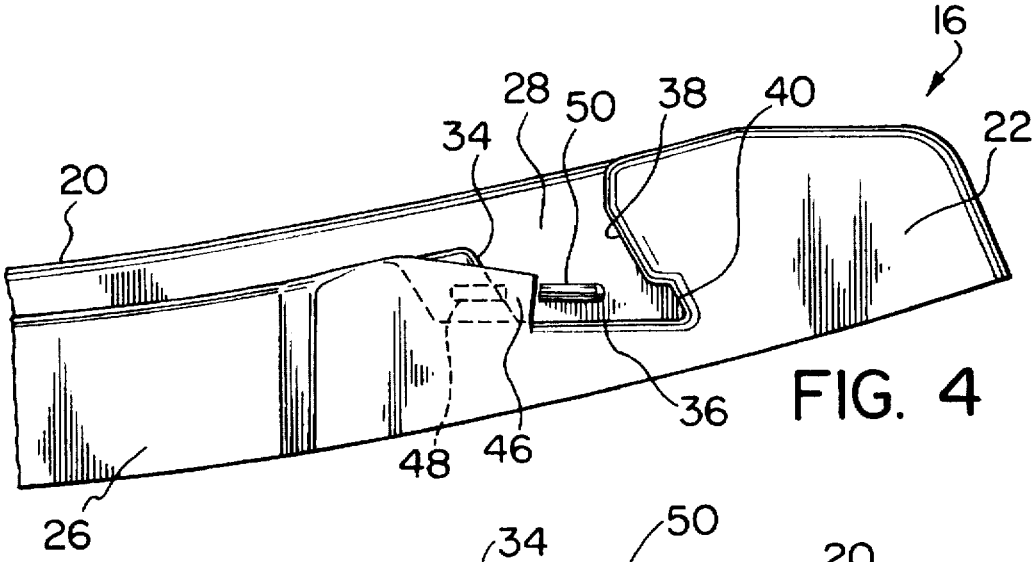
FIG. 4 is an enlarged side view of FIG. 3.
Figure 5:
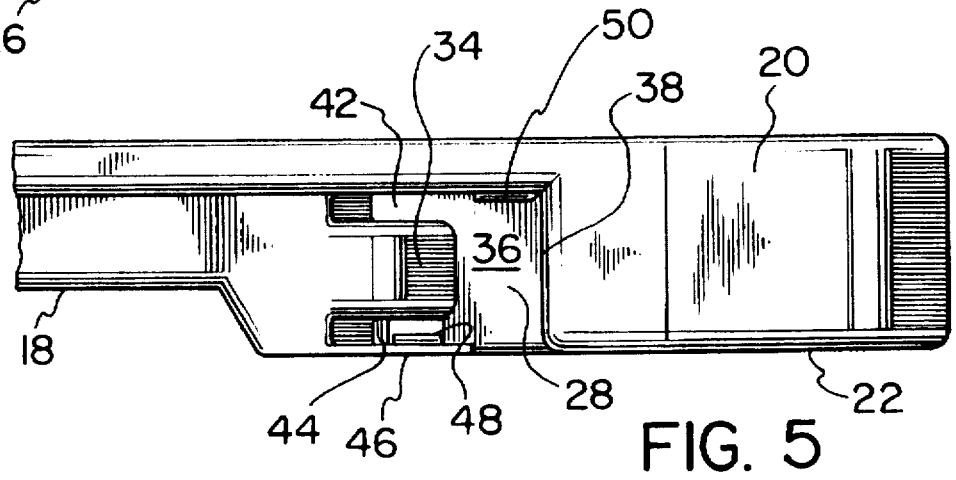
FIG. 5 is a localized top view of the rocker.

With reference to FIG. 2 and the remaining FIGS. 3 through 5 in the detailed description, each rocking member 16 includes an arcuate bottom wall 18 and an arcuate top wall 20 in spaced relation. An inside wall 22 is maintained in spaced relation to an outside wall 24. Inside wall 22 includes an inwardly directed recess wall portion 26, which is continuous with wall 22. Recess 26 is provided to enhance the strength of the rocking member 16, while at the same time reducing the amount of material employed in the manufacture of the rocking member 16.

Each rocking member 16 includes a first channel 28 for receiving at least a portion of a front leg 12 of chair 10 and a second channel 30 in spaced relation to the first channel 28, the second channel 30 for receiving at least a portion of the rear leg 14 of the chair 10.

Turning to the first channel 28, the same extends from the inside wall 22 and is elevated from bottom wall 18. The channel 28 terminates short of the outside wall 24 so that the outside wall 24 is solid and continuous as illustrated in FIG. 1. Channel 28 extends up through the top wall 20 and, in the example, extends from the first channel 28 to the second channel 30 via an open channel 32 extending downwardly through wall 20. It will be noted that although channel 32 is provided, the channel 32 need not be included, but rather channels 28 and 30 may include a small wall (not shown) so that the two channels are not in communication.

In greater detail with respect to the first channel 28, the same is configured to lock a foot portion positively therein (FIG. 1) and to this end, the channel 28 includes a rear wall 34 which is in a generally diagonal attitude relative to the base wall 18. This is shown more clearly in FIG. 4. Rear wall 34 terminates at a base wall 36, which is in a substantially horizontal disposition relative to wall 34. A front wall 38 is provided in spaced relation to rear wall 34 and is diagonally disposed to be in a parallel relationship with rear wall 34. Wall 38 includes a recess 40 contiguous therewith and terminating at base wall 36.

Flanking rear wall 34 on either side thereof are a pair of slots 42 and 44. Slots 42 and 44 are recessed rearwardly from rear wall 34 towards recessed wall 18 of rocking member 16.

Slot 44 includes an abutment or partial wall 46 integrally associated with wall 22 and in coplanar relationship therewith. Abutment 46 extends at least partially beyond the distance of rear wall 34 and in this manner, reduces the cross-sectional area of channel 28. Abutment 46 includes on the inside surface thereof at least one detent 48 for providing a snap lock to a foot portion (not shown) engaged therewith. Similarly, at least one detent 50 is provided on an inside surface of wall 24. In the example, detent 48 and 50 are in a diagonal and opposed relationship. Similar to detent 48, detent 50 provides a snap lock system to engage a foot portion (not shown) engaged therewith.

The second channel 30 includes similar elements as those provided for in the first channel 28, with the primary difference being that elements within the channel 30 are in an opposed relationship to those in channel 28. The similarity in the elements is reflected by the similar numerical designations.

In operation, the rocking members 16 provide a very effective lock system for locking in the foot portions of the chair engaged therewith as illustrated in FIG. 1. It has been found that the detents 48 and 50, slots 42 and 44, abutment 46 and recess 40 all function as locking arrangements for locking in the foot portion of a chair engaged therewith as illustrated in FIG. 1. In view of the fact that the channels 28 and 30 are bounded by the inside surface of outside wall 24, this functions as an abutment for the portion of a foot engaged therein and this is additionally complemented by the abutment 46 which reduces the overall cross-sectional area of each channel. In this manner, the foot is prevented from any lateral movement and this is complemented by the provision of a pair of slots 42 and 44. The detents 48 and 50 assist in preventing vertical displacement by positively engaging a foot portion (not shown). The recess 40 together with the overall shape of each channel 28 and 30 as well as the back wall 34 prevent displacement of a foot portion engaged therein a forward and backward motion. Accordingly, the arrangement is particularly useful to prevent movement in all three planes and therefore prevents inadvertent displacement of a foot when engaged therein.

Although only a single first channel and a single second channel have been shown for each rocking member, it will be readily apparent to those skilled in the art that many channels may be included between those shown in order to accommodate different configured chairs. It will be apparent to those skilled in the art that the configuration of the channels can be varied to accommodate the variety of different foot profiles. As an additional feature, the bottom wall portion 18 of each of the rocking members 16 include either a smooth wall (not shown) or the same may include some form of a textured material (not shown) in order to prevent slippage. Conveniently, the rockers may be molded in a one piece construction with the bottom wall optionally added in a second step.

Although embodiments of the invention have been described above, it is not limited thereto and it will be apparent to those skilled in the art that numerous modifications form part of the present invention insofar as they do not depart from the spirit, nature and scope of the claimed and described invention.

I claim:

1. Rocking members for releasable mounting on a chair having front legs and rear legs each leg having a foot portion, said rocking members each comprising:

a top wall and an arcuate bottom wall in spaced relation and an inside wall and an outside wall in spaced relation, each rocking member having first channel means for releasably receiving at least a portion of a front foot of a chair;

second channel means in spaced relation to said first channel means for receiving at least a portion of a rear foot of said chair;

said channel means extending within said inside wall and said top wall, said channel means terminating short of said outside wall;

abutment means in each channel means for preventing lateral movement of a respective foot portion adjacent said abutment means;

first lock means for releasably locking at least a portion of each said foot in said channel means, said first lock means being independent of said abutment means;

second lock means for releasably locking a portion of said foot different from said first lock means, said second lock means being independent of said abutment means and said first lock means; and third lock means for releasably locking a portion of said foot different from said first lock means and said second lock means, said third lock means being independent of said abutment means and said first lock means.

2. The rocking members of claim 1, in combination with a chair, said chair having front and back legs, each leg having a foot portion, said channel means of each rocking member engaged with a respective foot portion.

3. The rocking members as set forth in claim 1, wherein said abutment means comprises said inside wall.

4. The rocking members as set forth in claim 3, wherein said inside wall includes at least one detent for engaging a portion of a leg.

5. The rocking members as set forth in claim 4 wherein said top wall includes spaced apart slot means for receiving a portion of said foot, said slot means extending into said channel means.

6. The rocking members as set forth in claim 5, wherein at least one of said slot means includes a detent.

7. The rocking members as set forth in claim 5, wherein said slot means includes an abutment extending coplanarly from said inside wall for preventing lateral movement of a foot portion within said channel means.

8. In rocking members for releasable engagement with the feet of a chair, each said rocking member being generally arcuate in profile, each including channel means for receiving a portion of each foot of a chair, the improvement wherein each said rocking member includes a top wall and an arcuate bottom wall in spaced relation and an inside wall and an outside wall in spaced relation, said channel means extending within said inside wall and said top wall, said channel means terminating short of said outside wall, said inside wall including first lock means for releasably locking a first portion of a foot of a chair, said top wall including slot means for receiving a second portion of a foot of said chair, said slot means extending into said channel means and including second lock means independent of said first lock means, said second lock means for releasably locking said second portion of said chair.

9. The rocking members as set forth in claim 8, further including third lock means for releasably locking a portion of said foot different from said first lock means and said second lock means, said third lock means being independent of an abutment and said first lock means.

10. The rocking members of claim 8, in combination with a chair having front legs and rear legs, each leg having a foot portion, said channel means of each rocking member engaged with a respective foot portion.

11. The rocking members as set forth in claim 8, wherein each said rocking member includes a pair of channel means, each channel means being oppositely and angularly inclined relative to one another.

12. The rocking members as set forth in claim 8, wherein said rocking members form an assembly, said assembly including a pair of rocking members connected by cross members.

13. The rocking members as set forth in claim 8, wherein said first lock means includes at least one detent for releasably receiving a portion of each said foot.

14. The rocking members as set forth in claim 13, wherein said second locking means includes an abutment, said abutment including at least one detent.

15. The rocking members as set forth in claim 14, wherein said at least one detent of said first lock means and said second lock means are adjacent slot means in said channel means.

* * * * *